US008787603B2

(12) United States Patent
Fichtl et al.

(10) Patent No.: US 8,787,603 B2
(45) Date of Patent: Jul. 22, 2014

(54) METHOD FOR OPERATING A HEARING DEVICE AS WELL AS A HEARING DEVICE

(75) Inventors: Elmar Fichtl, Oetwil am See (CH); Michael Boretzki, Ruti (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 13/517,154

(22) PCT Filed: Dec. 22, 2009

(86) PCT No.: PCT/EP2009/067716
§ 371 (c)(1),
(2), (4) Date: Jun. 19, 2012

(87) PCT Pub. No.: WO2010/031880
PCT Pub. Date: Mar. 25, 2010

(65) Prior Publication Data

US 2013/0114836 A1 May 9, 2013

(51) Int. Cl.
*H04R 25/00* (2006.01)

(52) U.S. Cl.
USPC ..... 381/314

(58) Field of Classification Search
CPC ..... H04R 25/70; H04R 25/30
USPC ..... 381/314, 323, 23.1, 60, 312, 328, 330
See application file for complete search history.

(56) References Cited

U.S. PATENT DOCUMENTS

| | | | | |
|---|---|---|---|---|
| 2005/0036637 | A1 | 2/2005 | Janssen | |
| 2005/0129262 | A1 | 6/2005 | Dillon et al. | |
| 2006/0198530 | A1 * | 9/2006 | Fischer et al. | 381/60 |
| 2006/0222194 | A1 * | 10/2006 | Bramslow et al. | 381/314 |
| 2007/0147624 | A1 | 6/2007 | Fischer | |
| 2007/0203726 | A1 | 8/2007 | Thompson | |
| 2008/0107296 | A1 | 5/2008 | Bachler et al. | |

FOREIGN PATENT DOCUMENTS

| | | | |
|---|---|---|---|
| EP | 1208723 | B1 | 5/2002 |
| WO | 01/26419 | A1 | 4/2001 |
| WO | 2009-049672 | A1 | 4/2009 |
| WO | 2009/0144056 | A1 | 12/2009 |

OTHER PUBLICATIONS

International Search Report for PCT/EP2009/067716 dated Oct. 13, 2010.
Written Opinion for PCT/EP2009/067716 dated Oct. 13, 2010.

* cited by examiner

*Primary Examiner* — Brian Ensey
*Assistant Examiner* — Norman Yu
(74) *Attorney, Agent, or Firm* — Pearne & Gordon LLP

(57) ABSTRACT

Acclimatization of a hearing device user to a hearing device is made more acceptable by automatic acclimatization management. The intensity of the hearing device is increased in the long term, e.g. during several months. The speed of the intensity increase depends on user inputs. A user controls an audio processing parameter (APP), such as volume, with a user control. Each time the user switches the hearing device off and on again, the power-on value (POV) of the audio processing parameter (APP) is changed. The amount of the change depends on which settings for the audio processing parameter (APP) have been selected by the hearing device user and how long the settings have been active. An initial power-on value (iPOV) and a target power-on value (tPOV), which is to be reached at the end (H) of the acclimatization phase, may be programmed by an audiologist.

15 Claims, 4 Drawing Sheets

METHOD FOR OPERATING A HEARING DEVICE AS WELL AS A HEARING DEVICE

TECHNICAL FIELD

The present invention relates to the field of hearing devices. More particularly, the present invention relates to a method for operating a hearing device in a way that lets a user of said hearing device acclimatize to the hearing device. Furthermore, the present invention also relates to a hearing device.

BACKGROUND OF THE INVENTION

A hearing device is a device which compensates for the hearing loss of a user. A hearing device is usually worn at an ear or in the ear of the user. Additional devices such as a remote control may be considered to be part of the hearing device.

Usually, it takes some time for a user to get used to a hearing device. This process is called acclimatization and may take e.g. from several weeks up to half a year. Typically, hearing devices are tuned by a specialist such as an audiologist. It has been shown that acclimatization can be made more comfortable for a user if the intensity of the hearing device is initially low and is increased gradually during an acclimatization phase until target intensity is reached. Practically, this means that the hearing device user has to return to the specialist several times for a retuning. At each visit the intensity of the hearing device is increased.

In order to reduce the number of visits necessary and to make the adjustment more steady, it has been proposed to increase the intensity of hearing device automatically, a feature which is termed in this document "automatic acclimatization management".

For example, EP-B1-1 208 723 discloses a hearing device which automatically adjusts itself in time. The starting point as well as the end point of a parameter are defined according to the needs of the hearing device user. The adjustment is stepwise upon a trigger, which can be a clock event, an on-off event, a battery-replacement event or an event indicating that a knob has been operated a number of times. However, this solution has the disadvantage that the preferences of the user are not taken into account. The algorithm evaluates how long or how much the hearing device is used and not with which settings the hearing device is used. The hearing device is not able to determine if the user prefers a faster or a slower increase of the intensity of the hearing device.

It is to be noted that the term "automatic acclimatization management" generally means the adjustment which is activated when the hearing device is switched on, but the adjustment may then be modified by the hearing device user during everyday operation using a user control. Usually, such a modification by the hearing device user is "lost" once the hearing device is switched off and on again, since the user control is generally intended to adjust the hearing device to momentary situations and not for long-term adjustment or acclimatization management. However, it is known to statistically evaluate such settings by the user and to determine a new power-on-value for parameters based on such statistics. Such a feature is hereinafter called "user preference learning".

For example, WO 2009/049 672 A1 discloses a hearing device with learns from current user settings. If the user selects a higher volume and keeps this setting for an extended period of time, the power-on-volume is automatically adjusted. When the user switches on the hearing device the next time, the start volume will be a bit louder. Once the user gets used to a first volume, he or she might select then a higher second volume, then an even higher third volume etc. However, not all users show this behavior and after half a year, despite of the preference learning algorithm, the power-on-volume may still be the same. Conventional "user preference learning" is therefore not well suited for acclimatization management. In conventional "user preference learning", it is not possible to define a target value towards which the learning is biased. A similar known teaching is disclosed by US 2007/203726 A1.

SUMMARY OF THE INVENTION

The present invention addresses the problem to provide a method for operating a hearing device with an "automatic acclimatization management" which takes into account user preferences and which is able to assure that the acclimatization phase is not excessively long for reaching an acclimatization target condition.

This problem is solved by the features of claims 1 and 15, in particular by a method for operating a hearing device in a way that lets a user of said hearing device acclimatize to said hearing device, said hearing device comprising

- a signal processing unit,
- a user control by which at least one audio processing parameter of said signal processing unit is adjustable by said user,
- a non-volatile memory said method comprising the steps of:

a) writing a value indicative of a target power-on-value for said audio processing parameter to said non-volatile memory, b) waiting until said user switches on said hearing device, c) setting said audio processing parameter to a power-on-value, said power-on-value being stored in said non-volatile memory or being calculated from values stored in said non-volatile memory, d) allowing said user to continuously perform one or more adjustment actions by said user control for adjusting said audio processing parameter to his or her preferences in varying listening situations, e) executing an acclimatization algorithm simultaneously with step d), after step d) and/or before step c), said acclimatization algorithm being designed to approximate said power-on-value (POV) in the long term, in particular in more than a week, to said target power-on-value, said acclimatization algorithm determining a replacement value for said power-on-value taking into account which setting or settings for said audio processing parameter has or have been set by said user and how long said setting or settings have been active, f) repeating steps b) to e) until an acclimatization phase termination condition is fulfilled.

Taking into account which setting or settings for an audio processing parameter (APP) has or have been set by the hearing device user and how long said setting or settings have been active has the advantage that it opens up the possibility to implement a well balanced compromise between a forced acclimatization which cannot be influenced by the hearing device user at all and an acclimatization which fully relies on the selection of more intense settings by the hearing device user.

Further embodiments and advantages emerge from the claims and the description referring to the figures.

BRIEF DESCRIPTION OF THE DRAWINGS

The present invention is further described in more detail by referring to drawings showing exemplified embodiments.

The described embodiments are meant as examples and shall not confine the present invention.

DETAILED DESCRIPTION OF THE INVENTION

Figure 1:
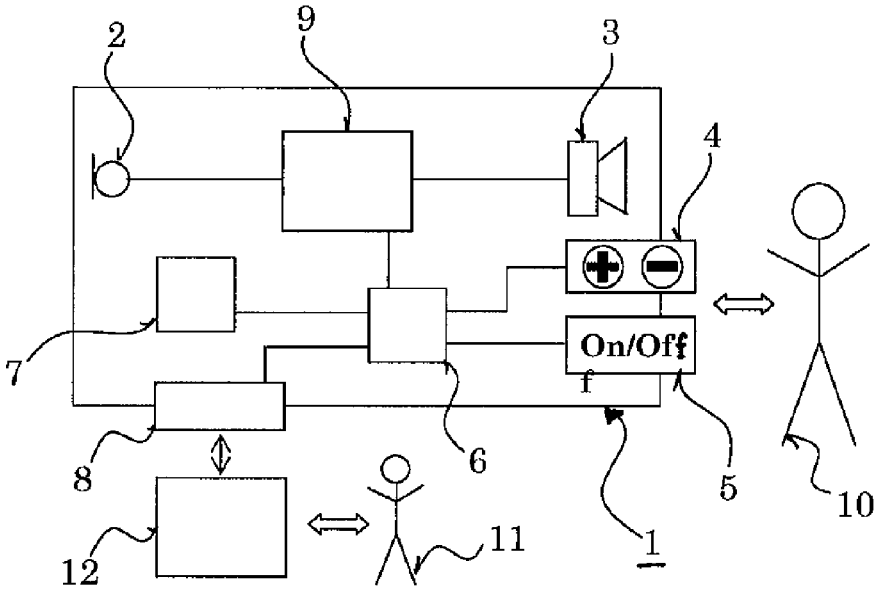
FIG. 1 shows a schematic diagram of a hearing device according to the present invention.

FIG. 1 shows a schematic diagram of a hearing device 1 according to one embodiment of the present invention. Sounds are picked up by a microphone 2, processed by a signal processor 9 and are presented to a hearing device user 10 by a receiver 3. The magnitude of the amplification can be controlled by a volume control 4. There is further an on/off switch 5. The signal processing is based on audio processing parameters. A controller 6 is adapted to set such parameters, for example, when the hearing device 1 is switched on or when the volume control 4 is actuated. There is a non-volatile memory 7 to store parameters while the hearing device 1 is switched off. The controller 6 is adapted to execute an acclimatization algorithm of the kind described further down below.

Figure 2:
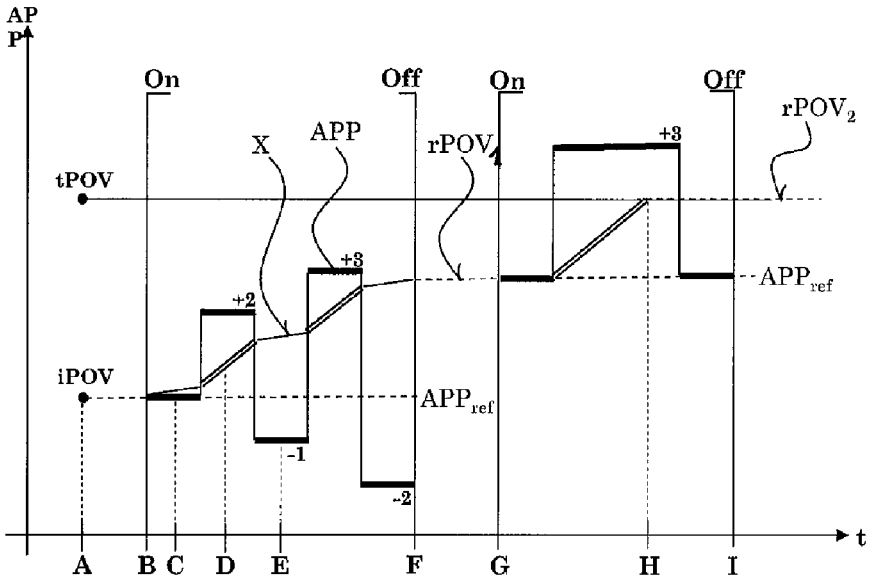
FIG. 2 shows how an audio processing parameter is changed over time in a hearing aid according to the present invention.

FIG. 2 shows how an audio processing parameter APP is changed over time in a hearing device 1 (FIG. 1) according to one embodiment of the present invention. The hearing device 1 is initially fitted to a hearing loss of a hearing device user 10 and is then used for an extended period of time, as for example several months, until the hearing device user 10 returns to the fitter, e.g. the audiologist.

At time "A", a fitter programs an initial power-on value iPOV for the audio processing parameter APP as well as a target power-on value tPOV. The audio processing parameter APP is typically volume but may also be something else, as, for example, treble or noise canceling. The target power-on value tPOV is, for example, 10 dB higher than the initial power-on value iPOV.

At time "B", the hearing device user 10 switches on the hearing device 1. The initial power-on-value iPOV is read from the non-volatile memory 7. The audio-processing parameter APP is set to the initial power-on value iPOV.

At time "C", the hearing device user 10 uses the hearing device 1 but has not actuated the control 4 yet. An intermediate value X which will later become the next power-on value is increased slowly.

At time "D", the hearing device user 10 has selected the audio-processing parameter APP to be two steps higher than the initial audio-processing parameter $APP_{ref}$. The intermediate value X is now increased faster.

At time "E", the hearing device user 10 has selected the audio-processing parameter APP to be one step lower than the initial audio-processing parameter $APP_{ref}$. The intermediate value X is now increased slower again.

At time "F", the hearing device user 10 switches off the hearing device 1. The intermediate value X is now stored frequently (e.g. every hour) in the non-volatile memory 7 to be the next power-on value. The intermediate value X lastly stored to the non-volatile memory 7 is therefore the first replacement power-on-value $rPOV_1$.

At time "G", the hearing device user 10 switches on the hearing device 1. The audio processing parameter APP is set to the previously stored power-on-value.

At time "H", the acclimatization phase ends. The intermediate value X has reached the target power-on-value tPOV. From this point on, the intermediate value X is not changed any more.

At time "I", the hearing device user 10 switches off the hearing device 1. The second replacement power-on-value $rPOV_2$ which is now stored in the non-volatile memory 7 is the target power-on-value tPOV.

It is to be noted that the increase of the intermediate value X as well as the power-on-value POV is shown exaggerated for illustrative purposes. Usually, the acclimatization phase will take few weeks up to several months and not only one and a half days as in the example. It is also to be noted that, since acclimatization is a rather slow process, it does not matter if the change due to the acclimatization algorithm is already applied during the current usage period, or, as shown in FIG. 2, not until the hearing device 1 is switched off and on again.

Preferably, the acclimatization process is controlled by software being executed on the controller 6 (FIG. 1). Hence, the controller 6 is adapted to perform the following steps:

a) writing a value indicative of said target power-on value tPOV for said audio processing parameter APP to the non-volatile memory 7, b) waiting until the hearing device user 10 switches on the hearing device 1, c) setting said audio processing parameter APP to a power-on value POV, said power-on value POV being stored in said non-volatile memory 7 or being calculated from values stored in said non-volatile memory 7, d) allowing said hearing device user 10 to continuously perform one or more adjustment actions by the control 4 for adjusting said audio processing parameter APP to his or her preferences in varying listening situations, e) executing an acclimatization algorithm simultaneously with step d), after step d) and/or before step c), said acclimatization algorithm being designed to approximate said power-on value POV in the long term, in particular in more than a week, to said target power-on value tPOV, said acclimatization algorithm determining a replacement value rPOV for said power-on value POV taking into account which setting or settings for said audio processing parameter APP has or have been set by said hearing device user 10 and how long said setting or settings have been active.

Steps b) to e) are repeated until an acclimatization phase termination condition is fulfilled. The acclimatization phase termination condition can be one of the following:

the power-on value POV is above a threshold value T;

the intermediate value X is above a threshold value T.

The threshold value T be the target power-on value tPOV itself or it can be calculated from it by a formula:

$$T = \text{tPOV} - \text{dist},$$

in particular with $$\text{dist} = p^*(\text{tPOV} - \text{iPOV})$$

iPOV is an initial power-on value. For example, dist is equal to 1 dB, and p is equal to 0.1, for example.

In the example depicted in FIG. 2, the power-on value POV remains constant after the acclimatization phase ends. However, the acclimatisation algorithm can also be replaced by an unbiased user preference learning algorithm after termination of the acclimatization phase. Executing a user preference learning algorithm can lead to a condition where the acclimatization termination condition is not fulfilled any more, for example, if the hearing device user keeps selecting a lower volume. In this case, it is possible to automatically reactivate the acclimatization algorithm.

Figure 3:
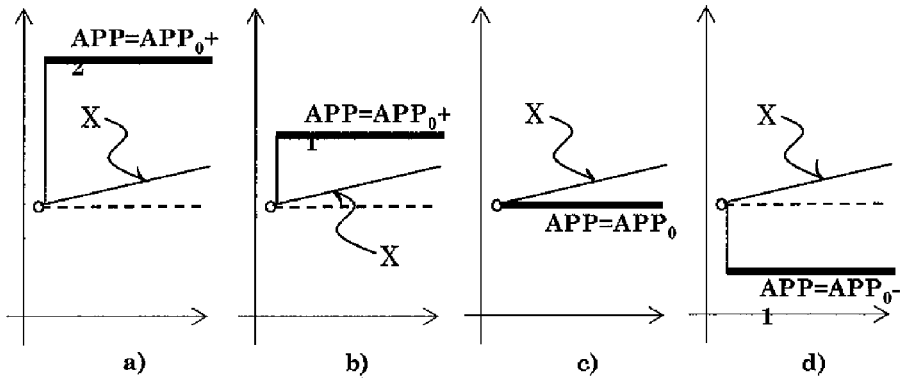
FIG. 3 shows an example of a linear acclimatization management without taking into account user inputs.

FIG. 3 illustrates an example of a linear acclimatization algorithm which does not take into account user inputs and which is known in the state of the art. The inclination of the line representing intermediate value X is independent of how the audio processing parameter APP was adjusted by the hearing device user 10. In FIG. 3*a*, it was adjusted by adding two steps, in FIG. 3*b* by adding one step, in FIG. 3*c* it was not adjusted at all and in FIG. 3*d* it was adjusted by subtracting one step. In each case, the adjustment was performed right after switching the hearing device 1 on. The intermediate value X can be calculated periodically by the following update function:

$$X_N = f_U(X_{N-1}),$$

in particular $$X_N = X_{N-1} + \text{const}$$

$X_N$ is the result of the N-th calculation of the update function since the hearing device 1 was last switched on. $X_0$ is defined to be the power-on value POV. The last intermediate value $X_{[Max(N)]}$ being calculated before the hearing device 1 is switched off is the replacement power-on value rPOV that is stored as new power-on value POV.

Since the function uses the result of the previous calculation of the function, it is a recursive function. The speed of the acclimatization can be selected by choosing a suitable update interval, as for example one hour as well as a suitable value for const, as for example 0.001 dB. The principles explained referring to FIG. 3 also apply for the update functions $f_U$ described below.

Figure 4:
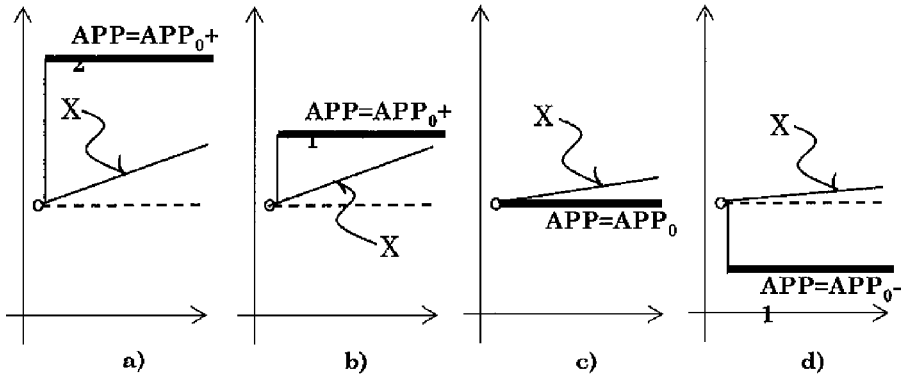
FIG. 4 shows an example of a linear acclimatization management with taking into account user inputs.

FIG. 4 illustrates an example of a user input dependent linear acclimatization algorithm according to one embodiment of the present invention. It takes into account which setting or settings have been chosen by the hearing device user 10 and how long such setting or settings have been active. When the hearing device user 10 has increased the audio processing parameter APP by one or two steps, acclimatization is faster (FIGS. 4*a* and 4*b*). When the audio processing parameter APP is left at the power-on value POV, acclimatization is slower (FIG. 4*c*), and when the hearing device user 10 has decreased the audio processing parameter APP by one step, acclimatization is even slower (FIG. 4*d*). The intermediate value X is calculated periodically, for example every minute, by the following update function:

$$X_N = f_U(X_{N-1}, \text{APP}_N)$$

The update function is in particular $$f_U(X_{N-1}, APP_N) = \begin{cases} X_{N-1} + \text{alpha for } APP_N > X_{ref} \\ X_{N-1} + \text{beta for } APP_N = X_{ref} \\ X_{N-1} + \text{gamma for } APP_N < X_{ref} \end{cases}$$

$\text{APP}_N$ is a current setting for the audio processing parameter APP. $\text{APP}_N$ can be influenced by the hearing device user 10 for N>0, $\text{APP}_0$ is defined to be the power-on value POV stored in the non-volatile memory 7. Preferably, one of the following conditions applies:

$$\text{alpha} \geq \text{beta} \geq \text{gamma} \geq 0$$

$$\text{alpha} \geq \text{beta} \geq \text{gamma}$$

$X_{ref}$ is a reference value and can either be $X_0$ or $X_{N-1}$.

An alternative user input dependent linear acclimatization algorithm is defined by the following update function for intermediate value X:

$$f_U(X_{N-1}, APP_N) = \begin{cases} X_{N-1} + a*(APP_N - APP_{ref}) \text{ for } APP_N > X_{ref} + b \\ X_{N-1} + b \text{ for } APP_N = [X_{ref} - b, X_{ref} + b] \\ X_{N-1} + c*(APP_N - APP_{ref})^{-1} \text{ for } APP_N < X_{ref} - b \end{cases}$$

Figure 5:
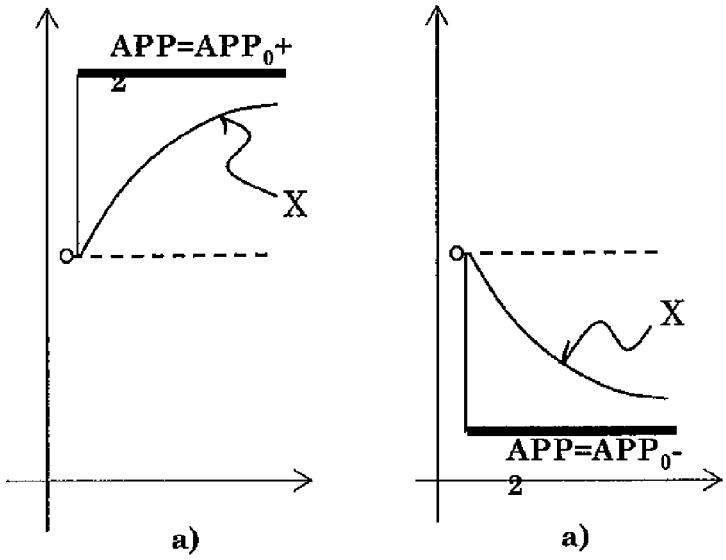
FIG. 5 shows an example of an unbiased user preference learning.

FIG. 5 illustrates an example of an unbiased user preference learning algorithm which is known in the state of the art. The algorithm is designed to determine a setting statistically preferred by a hearing device user 10 for the audio processing parameter APP. The algorithm is unbiased because its behavior is the same, independent of whether a positive (FIG. 5*a*) or negative (FIG. 5*b*) adjustment has been applied by the hearing device user 10.

The intermediate value X is calculated by the following periodically calculated update function:

$$X_N = X_{N-1} * \text{weight} + \text{APP}_N * (1 - \text{weight})$$

Weight is a parameter indicating how much previous learnt values are to be regarded relative to the present setting of the audio processing parameter $\text{APP}_N$.

Figure 6:
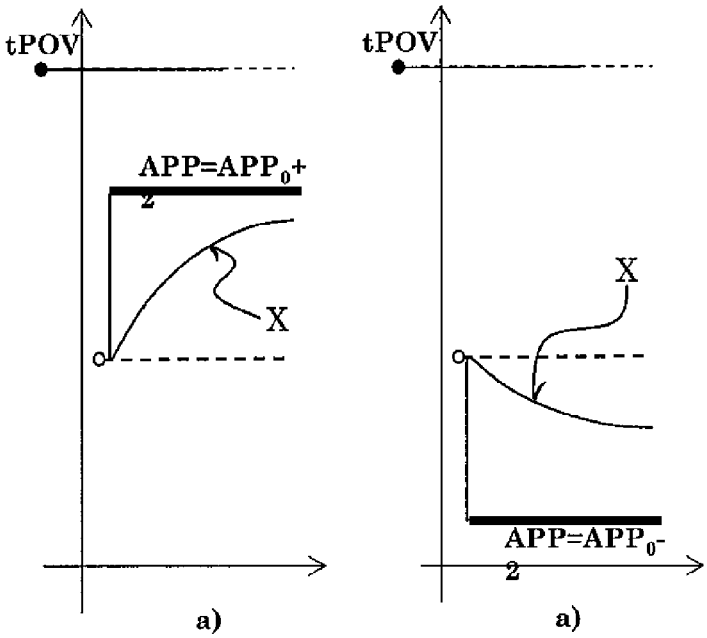
FIG. 6 shows an example of a biased user preference learning.

FIG. 6 illustrates an example of a biased user preference learning algorithm. The learning algorithm is derived from the unbiased learning algorithm described referring to FIG. 5. The learning algorithm is biased because adjustments by the hearing device user 10 in a first adjustment direction are taken into account stronger than adjustments in an opposing second adjustment direction. The first adjustment direction is the direction towards the target power-on value tPOV. The adjustments in the first adjustment direction are implemented by applying a faster learning speed than for adjustments in the second adjustment direction. If the audio processing parameter APP is volume, the first adjustment direction is louder—the device becomes more intense—and the second adjustment direction is softer. The intermediate value X is calculated by the following periodically calculated update function:

$$f_U(X_{N-1}, APP_N) = \begin{cases} X_{N-1} * W_A + APP_N * (1 - W_A) \text{ for } APP_N > X_{ref} \\ X_{N-1} * W_B + APP_N * (1 - W_B) \text{ for } APP_N = X_{ref} \\ X_{N-1} * W_C + APP_N * (1 - W_C) \text{ for } APP_N < X_{ref} \end{cases}$$

The user input dependent speed of learning is defined by selecting $$W_A \neq W_C$$

wherein in particular $$W_A \leq W_B \leq W_C.$$

$X_{ref}$ is a reference value and can either be $X_0$ or $X_{N-1}$.

An alternative biased user preference learning algorithm is defined by the following update function for intermediate value X:

$$f_U(X_{N-1},\mathrm{APP}_N)=X_{N-1}*W(\mathrm{APP}_N)+\mathrm{APP}_N*(1-W(\mathrm{APP}_N))$$

wherein $$W(APP_N)=\begin{cases} A*f(APP_N-APP_{ref}) & \text{for } APP_N>X_{ref} \\ B*f(APP_N-APP_{ref}) & \text{for } APP_N=X_{ref} \\ C*f(APP_N-APP_{ref}) & \text{for } APP_N<X_{ref} \end{cases}$$

Figure 7:
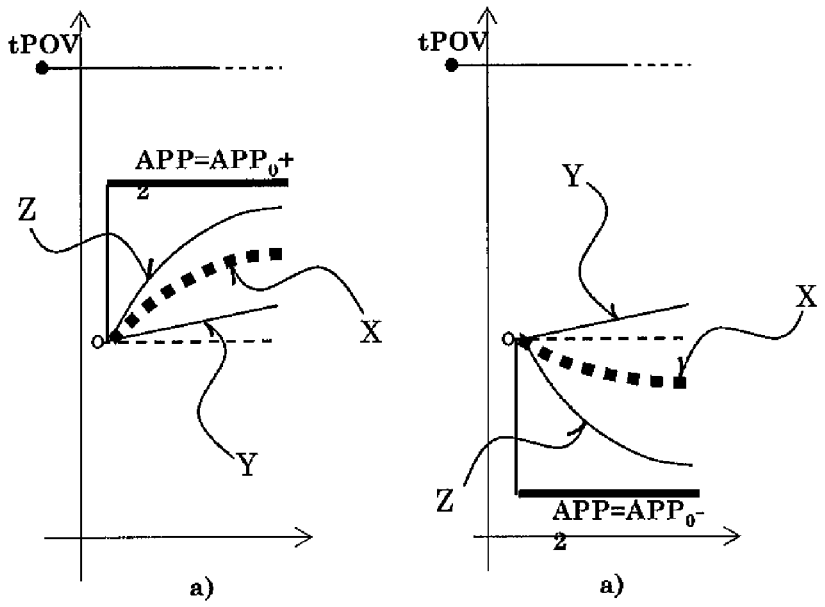
FIG. 7 shows a further example of a biased user preference learning.

FIG. 7 shows a further example of a biased user preference learning algorithm. It is a combination of the linear acclimatization algorithm shown in FIG. 3 and the biased user preference learning algorithm shown in FIG. 6. The acclimatization algorithm periodically calculates, while the hearing device 1 is on, an intermediate acclimatization value Y based on an acclimatization update function $$Y_N=Y_{N-1}+\mathrm{step}$$

as well as an intermediate learning value Z based on a learning update function $$Z_N=\begin{cases} Z_{N-1}*W_A+APP_N*(1-W_A) & \text{for } APP_N>Z_{ref} \\ Z_{N-1}*W_B+APP_N*(1-W_B) & \text{for } APP_N=Z_{ref} \\ Z_{N-1}*W_C+APP_N*(1-W_C) & \text{for } APP_N<Z_{ref} \end{cases}$$

$Y_N$ is the result of the N-th calculation of the acclimatization update function since the hearing device 1 was last switched on, wherein $Y_0$ is defined to be $APP_0$. $Z_N$ is the result of the N-th calculation of the learning update function since the hearing device was last switched on, wherein $Z_0$ is defined to be $APP_0$. $APP_N$ is a current setting for the audio processing parameter APP. $APP_N$ can be influenced by the hearing device user for N>0. $APP_0$ is the power-on value (POV) stored in the non-volatile memory 7. The replacement value rPOV for the power-on value is calculated by a weighted average from the last intermediate acclimatization value $Y_{[max(N)]}$ and the last intermediate learning value $Z_{[max(N)]}$ being calculated before the hearing device is switched off, according to the formula $$\mathrm{rPOV}=Y_{[max(N)]}*\mathrm{weight}+Z_{[max(N)]}*(1-\mathrm{weight})$$

rPOV is stored as the power-on-value (POV).

In the above examples, the user preference learning algorithm as well as the acclimatization algorithm is defined by a periodically calculated update function. However, such algorithm may also be described in more general terms by the following function:

$$\mathrm{rPOV}=f(\mathrm{POV},\mathrm{APP}_1,\mathrm{APP}_2,\mathrm{APP}_3\ldots)$$

wherein POV is the power-on value, rPOV is the replacement power-on value, and $APP_N$ is a sample of the audio processing parameter APP at a particular time $t_N$. $APP_1$ is, for example, the first sample after the hearing device is switched on. It does not matter when the functions or parts of the function are calculated. It may be calculated as soon as the necessary APP samples are available, i.e. during ongoing operation of the hearing device, but it is also possible to store samples or intermediate results in the non-volatile memory 7 and to calculate the function not before the hearing device 1 is switched on the next time.

The invention claimed is:

1. A method for operating a hearing device (1) in a way that lets a hearing device user (10) acclimatize to said hearing device (1), said hearing device (1) comprising:

a signal processing unit (9), a user control (4) by which at least one audio processing parameter (APP) of said signal processing unit (9) is adjustable by said hearing device user (10), and a non-volatile memory (7), said method comprising the steps of:

a) writing a value indicative of a target power-on value (tPOV) for said audio processing parameter (APP) to said non-volatile memory (7), b) waiting until said hearing device user (10) switches on said hearing device (1), c) setting said audio processing parameter (APP) to a power-on value (POV), said power-on value (POV) being either stored in said non-volatile memory (7) or being calculated from values stored in said non-volatile memory (7), d) allowing said hearing device user (10) to continuously perform one or more adjustment actions by said user control (4) for adjusting said audio processing parameter (APP) to said hearing device user's preferences in varying listening situations, e) executing an acclimatization algorithm simultaneously with step d), after step d) and/or before step c), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said hearing device user (10) and how long said setting or settings have been active, and f) repeating steps b) to e) until an acclimatization phase termination condition is fulfilled, wherein said acclimatization algorithm is a biased user preference learning algorithm, said biased user preference learning algorithm being derived from an unbiased user preference learning algorithm which is designed to determine a setting statistically preferred by said hearing device user (10) for said audio processing parameter (APP), said biased user preference learning algorithm being responsive to said adjustment actions in a way that adjustments in a first adjustment direction are taken into account stronger than adjustments in an opposing second adjustment direction, wherein said first adjustment direction is a direction towards said target power-on value (tPOV).

2. The method according to claim 1, wherein the adjustments in the first adjustment direction are implemented by applying a faster learning speed than for adjustments in the second adjustment direction.

3. The method according to one of the preceding claims, wherein said audio processing parameter (APP) is volume, and said first adjustment direction is louder and said second adjustment direction is softer.

4. A method for operating a hearing device (1) in a way that lets a hearing device user (10) acclimatize to said hearing device (1), said hearing device (1) comprising:

a signal processing unit (9), a user control (4) by which at least one audio processing parameter (APP) of said signal processing unit (9) is adjustable by said hearing device user (10), and a non-volatile memory (7), said method comprising the steps of:

a) writing a value indicative of a target power-on value (tPOV) for said audio processing parameter (APP) to said non-volatile memory (7), b) waiting until said hearing device user (10) switches on said hearing device (1), c) setting said audio processing parameter (APP) to a power-on value (POV), said power-on value (POV) being either stored in said non-volatile memory (7) or being calculated from values stored in said non-volatile memory (7), d) allowing said hearing device user (10) to continuously perform one or more adjustment actions by said user control (4) for adjusting said audio processing parameter (APP) to said hearing device user's preferences in varying listening situations, e) executing an acclimatization algorithm simultaneously with step d), after step d) and/or before step c), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said hearing device user (10) and how long said setting or settings have been active, and f) repeating steps b) to e) until an acclimatization phase termination condition is fulfilled, wherein said acclimatization algorithm periodically calculates, while said hearing device (1) is on, an intermediate value (X) based on an update function:

$$X_N = f_U(X_{N-1}, \mathrm{APP}_N)$$

wherein $X_N$ is a result of an N-th calculation of said update function since said hearing device (1) was last switched on, wherein $X_0$ is defined to be a first audio processing parameter $\mathrm{APP}_0$, $\mathrm{APP}_N$ is a current setting for said audio processing parameter (APP), wherein $\mathrm{APP}_N$ can be influenced by said hearing device user (10) for N>0, while $\mathrm{APP}_0$ is defined to be said power-on value (POV) stored in said non-volatile memory (7), wherein a last intermediate value ($X_{[Max(N)]}$)—being calculated before said hearing device (1) is switched off—is said replacement power-on value (rPOV) that is stored as a new power-on value (POV).

5. The method according to claim 4, wherein said update function is a user input dependent linear acclimatization function $$f_U(X_{N-1}, APP_N) = \begin{cases} X_{N-1} + \text{alpha for } APP_N > X_{ref} \\ X_{N-1} + \text{beta for } APP_N = X_{ref} \\ X_{N-1} + \text{gamma for } APP_N < X_{ref} \end{cases}$$

wherein one of the following conditions applies:

alpha≥beta≥gamma or alpha≥beta≥gamma≥0 and $X_{ref} = X_0$ or $X_{ref} = X_{N-1}$.

6. The method according to claim 4, wherein said update function is a biased user preference learning function $$f_U(X_{N-1}, APP_N) = \begin{cases} X_{N-1} * W_A + APP_N * (1 - W_A) \text{ for } APP_N > X_{ref} \\ X_{N-1} * W_B + APP_N * (1 - W_B) \text{ for } APP_N = X_{ref} \\ X_{N-1} * W_C + APP_N * (1 - W_C) \text{ for } APP_N < X_{ref} \end{cases}$$

wherein a user input dependent speed of learning is defined by selecting $W_A \neq W_C$ wherein $W_A \leq W_B \leq W_C$ and $X_{ref} = X_0$ or $X_{ref} = X_{N-1}$.

7. The method according to claim 4, wherein said update function is a user input dependent linear acclimatization function $$f_U(X_{N-1}, APP_N) = \begin{cases} X_{N-1} + a * (APP_N - APP_{ref}) \text{ for } APP_N > X_{ref} + b \\ X_{N-1} + b \text{ for } APP_N = [X_{ref} - b, X_{ref} + b] \\ X_{N-1} + c * (APP_N - APP_{ref})^{-1} \text{ for } APP_N < X_{ref} - b \end{cases}$$

wherein $\mathrm{APP}_{ref} = X_{ref} = X_0$ or $\mathrm{APP}_{ref} = X_{ref} = X_{N-1}$.

8. The method according to claim 4, wherein said update function is a biased user preference learning function $$f_U(X_{N-1}, \mathrm{APP}_N) = X_{N-1} * W(\mathrm{APP}_N) + \mathrm{APP}_N * (1 - W(\mathrm{APP}_N))$$

wherein $$W(APP_N) = \begin{cases} A * f(APP_N - APP_{ref}) \text{ for } APP_N > X_{ref} \\ B * f(APP_N - APP_{ref}) \text{ for } APP_N = X_{ref} \\ C * f(APP_N - APP_{ref}) \text{ for } APP_N < X_{ref} \end{cases}$$

wherein $\mathrm{APP}_{ref} = X_{ref} = X_0$ or $\mathrm{APP}_{ref} = X_{ref} = X_{N-1}$.

9. A method for operating a hearing device (1) in a way that lets a hearing device user (10) acclimatize to said hearing device (1), said hearing device (1) comprising:

a signal processing unit (9), a user control (4) by which at least one audio processing parameter (APP) of said signal processing unit (9) is adjustable by said hearing device user (10), and a non-volatile memory (7), said method comprising the steps of:

a) writing a value indicative of a target power-on value (tPOV) for said audio processing parameter (APP) to said non-volatile memory (7), b) waiting until said hearing device user (10) switches on said hearing device (1), c) setting said audio processing parameter (APP) to a power-on value (POV), said power-on value (POV) being either stored in said non-volatile memory (7) or being calculated from values stored in said non-volatile memory (7), d) allowing said hearing device user (10) to continuously perform one or more adjustment actions by said user control (4) for adjusting said audio processing parameter (APP) to said hearing device user's preferences in varying listening situations, e) executing an acclimatization algorithm simultaneously with step d), after step d) and/or before step c), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said hearing device user (10) and how long said setting or settings have been active, and f) repeating steps b) to e) until an acclimatization phase termination condition is fulfilled, wherein said acclimatization algorithm periodically calculates, while said hearing device (1) is on, an intermediate acclimatization value (Y) based on an acclimatization update function $$Y_N = Y_{N-1} + \text{step}$$

as well as an intermediate learning value (Z) based on a learning update function $$Z_N = \begin{cases} Z_{N-1} * W_A + APP_N * (1 - W_A) & \text{for } APP_N > Z_{ref} \\ Z_{N-1} * W_B + APP_N * (1 - W_B) & \text{for } APP_N > Z_{ref} \\ Z_{N-1} * W_C + APP_N * (1 - W_C) & \text{for } APP_N > Z_{ref} \end{cases}$$

wherein $Y_N$ is a result of an N-th calculation of said acclimatization update function since said hearing device (1) was last switched on, wherein $Y_0$ is defined to be $APP_0$, $Z_N$ is a result of an N-th calculation of said learning update function since said hearing device (1) was last switched on, wherein $Z_0$ is defined to be $APP_0$, $APP_N$ is a current setting for said audio processing parameter (APP), wherein $APP_N$ can be influenced by said hearing device user (10) for N>0, while $APP_0$ is defined to be said power-on value (POV) stored in said non-volatile memory (7), wherein said replacement power-on value (rPOV) is calculated by a weighted average from a last intermediate acclimatization value ($Y_{[max(N)]}$) and a last intermediate learning value ($Z_{[max(N)]}$) being calculated before said hearing device (1) is switched off, according to the formula $$\text{rPOV} = Y_{[max(N)]} * \text{weight} + Z_{[max(N)]} * (1 - \text{weight})$$

and is stored as said power-on value (POV).

10. A method for operating a hearing device (1) in a way that lets a hearing device user (10) acclimatize to said hearing device (1), said hearing device (1) comprising:

a signal processing unit (9), a user control (4) by which at least one audio processing parameter (APP) of said signal processing unit (9) is adjustable by said hearing device user (10), and a non-volatile memory (7), said method comprising the steps of:

a) writing a value indicative of a target power-on value (tPOV) for said audio processing parameter (APP) to said non-volatile memory (7), b) waiting until said hearing device user (10) switches on said hearing device (1), c) setting said audio processing parameter (APP) to a power-on value (POV), said power-on value (POV) being either stored in said non-volatile memory (7) or being calculated from values stored in said non-volatile memory (7), d) allowing said hearing device user (10) to continuously perform one or more adjustment actions by said user control (4) for adjusting said audio processing parameter (APP) to said hearing device user's preferences in varying listening situations, e) executing an acclimatization algorithm simultaneously with step d), after step d) and/or before step c), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said hearing device user (10) and how long said setting or settings have been active, and f) repeating steps b) to e) until an acclimatization phase termination condition is fulfilled, wherein said acclimatization algorithm is a function $$\text{rPOV} = f(\text{POV}, \text{APP}_1, \text{APP}_2, \text{APP}_3 \ldots)$$

wherein POV is said power-on value, rPOV is said replacement power-on value for said power-on value and $APP_N$ is a sample of said audio processing parameter (APP) at a particular time ($t_N$).

11. A method for operating a hearing device (1) in a way that lets a hearing device user (10) acclimatize to said hearing device (1), said hearing device (1) comprising:

a signal processing unit (9), a user control (4) by which at least one audio processing parameter (APP) of said signal processing unit (9) is adjustable by said hearing device user (10), and a non-volatile memory (7), said method comprising the steps of:

a) writing a value indicative of a target power-on value (tPOV) for said audio processing parameter (APP) to said non-volatile memory (7), b) waiting until said hearing device user (10) switches on said hearing device (1), c) setting said audio processing parameter (APP) to a power-on value (POV), said power-on value (POV) being either stored in said non-volatile memory (7) or being calculated from values stored in said non-volatile memory (7), d) allowing said hearing device user (10) to continuously perform one or more adjustment actions by said user control (4) for adjusting said audio processing parameter (APP) to said hearing device user's preferences in varying listening situations, e) executing an acclimatization algorithm simultaneously with step d), after step d) and/or before step c), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said hearing device user (10) and how long said setting or settings have been active, and f) repeating steps b) to e) until an acclimatization phase termination condition is fulfilled, wherein said acclimatization phase termination condition is one of the following:

said power-on value (POV) being equal or above a threshold value (T), said intermediate value (X) being equal or above a threshold value (T), wherein said threshold value (T) is obtained by one of the following steps:

being derived from said value indicative of a target power-on value (tPOV), being calculated by the formula $$T=\text{tPOV}-\text{dist}$$

being calculated by the formula $$T=\text{tPOV}-p*(\text{tPOV}-\text{iPOV})$$

wherein T is said threshold value (T), dist defines a vicinity of said target power-on value (tPOV), tPOV is said target power-on value (tPOV), iPOV is an initial power-on value (iPOV) and p is equal to 0.1.

12. The method according to claim 1, wherein said acclimatization algorithm is replaced by an unbiased user preference learning algorithm once said acclimatization phase termination condition is fulfilled.

13. The method according to claim 12, wherein said acclimatization algorithm is executed again, once said acclimatization phase termination condition is not fulfilled any more.

14. A hearing device (1) comprising:

an input transducer (2) for picking up environment sounds, a signal processing unit (9) for adapting sounds to a hearing loss of a hearing device user (10), an output transducer (3) for delivering adapted sounds to an ear of said hearing device user (10), a fitting interface (8) for adjusting said hearing device (1) to the needs of said hearing device user (10), a first user control (5) for allowing said hearing device user (10) to switch on and off said hearing device (1), a second user control (4) by which at least one audio processing parameter (APP) of said signal processing unit (9) is adjustable by said hearing device user (10), a non-volatile memory (7), and a controller (6), wherein said fitting interface (8) is adapted to write an initial power-on value (iPOV) and a value indicative of a target power-on value (tPOV) for said audio processing parameter (APP) to said non-volatile memory (7), and wherein said controller (6) is adapted to set said audio processing parameter (APP) to a power-on value (POV) when said hearing device (1) has been powered on, whereon said power-on value (POV) is stored in said non-volatile memory (7) or is calculated from values stored in said non-volatile memory (7), to adjust said audio processing parameters (APP) to said hearing device user's preferences in varying listening situations according to said hearing device user (10) performing one or more adjustment actions by said user control (4), to execute an acclimatization algorithm simultaneously with or after said adjustment actions at said user control (4) and/or before setting said audio processing parameter (APP) to a power-on value (POV), said acclimatization algorithm being designed to approximate said power-on value (POV) to said target power-on value (tPOV) after at least a week, said acclimatization algorithm determining a replacement power-on value (rPOV) for said power-on value (POV) taking into account which setting or settings for said audio processing parameter (APP) has or have been set by said second user control (4) being actuated and how long said setting or settings have been active, until said power-on value (POV) is sufficiently close to said target power-on value (tPOV), wherein said acclimatization algorithm is a biased user preference learning algorithm, said biased user preference learning algorithm being derived from an unbiased user preference learning algorithm which is designed to determine a setting statistically preferred by said hearing device user (10) for said audio processing parameter (APP), said biased user preference learning algorithm being responsive to adjustment actions by said second user control (4) in a way that adjustments in a first adjustment direction are taken into account stronger than adjustments in an opposite second adjustment direction, wherein said first adjustment direction is a direction towards said target power-on value (tPOV).

15. The method according to claim 1, wherein step a) further comprises initially fitting said hearing device (1) to a hearing loss of said hearing device user (10) by a fitter programming an initial power-on value (iPOV) and the value indicative of said target power-on value (tPOV) for said audio processing parameter (APP) to said non-volatile memory (7).

* * * * *